United States Patent [19]

Massey

[11] 4,281,803

[45] Aug. 4, 1981

[54] SPLICER CONTROL

[75] Inventor: William A. Massey, Mt. Holly, N.J.

[73] Assignee: Molins Machine Company, Inc., Cherry Hill, N.J.

[21] Appl. No.: 95,846

[22] Filed: Nov. 19, 1979

[51] Int. Cl.[3] ..... B65H 19/18

[52] U.S. Cl. ..... 242/58.1; 156/504

[58] Field of Search ..... 242/58.1, 58.2, 58.3, 242/58.4; 156/504, 505, 506

[56] References Cited

U.S. PATENT DOCUMENTS

| | | | |
|---|---|---|---|
| Re. 29,365 | 8/1977 | Butler | 242/58.3 |
| 3,713,600 | 1/1973 | Murray | 242/58.4 |
| 3,746,272 | 7/1973 | Rotolo | 242/58.3 |
| 3,822,838 | 7/1974 | Butler | 242/75.44 |
| 3,836,089 | 9/1974 | Reimersma | 242/58.1 |
| 3,841,944 | 10/1974 | Harris | 156/504 |
| 3,891,158 | 6/1975 | Shegron | 242/58.1 |
| 3,918,655 | 11/1975 | Hillner | 242/58.1 |
| 4,089,482 | 5/1978 | Mooney | 242/58.1 |
| 4,100,012 | 7/1978 | Meihofer | 242/58.4 |

*Primary Examiner*—Edward J. McCarthy

*Attorney, Agent, or Firm*—Seidel, Gonda, Goldhammer & Panitch

[57] ABSTRACT

The web from a running roll passes through a festoon in which an amount of web is stored. Upon the application of a splice command signal, the speed of the running roll is reduced from an initial or line speed V linearly at a rate R1. As the speed of the running roll decreases, the rate at which the festoon web length decreases reaches a preselected fraction of the speed V. This indicates that the running roll is stopped. A splice initiate signal is then generated. The web from the running roll is spliced to the web from a reserve roll. Following the splice, the speed of the web from the reserve roll is accelerated linearly at a rate R2 to speed V. If the rate of reduction of running roll speed is independent of the initial speed V, the same web tensions are experienced during braking of the running roll regardless of the initial speed V. If the rate is made dependent on the initial speed V, lower web tensions are experienced during braking for lower initial speeds V. By accurately controlling the rates of acceleration and deceleration the timing and web travel during splices are predictable, suiting the splicer to use in an automated system where splices are to be matched.

22 Claims, 5 Drawing Figures

SPLICER CONTROL

BACKGROUND OF THE INVENTION

The present invention is directed to a splicer control. In particular, the invention is directed to a web splicer control wherein the web from a running roll is spliced to the web from a reserve roll after the running roll has stopped.

In most machines of this type, the web is drawn through an accumulator or festoon which aids in maintaining tension on the web and supplies web to a web consuming machine without interruption while the running roll is stopped to allow the web from the reserve roll to be spliced to the web from the running roll and the reserve roll to be accelerated to the prior speed of the running roll. Generally, the accelerating affect is induced by the web consuming machine and by a tension device in the web festoon which maintains proper tension in the new web as its speed is increased.

Typical of such machines are those described in U.S. Pat. Nos. 3,841,944; 3,891,158 and U.S. Pat. No. Re. 29,365. The machine described in U.S. Pat. No. 3,841,944 requires the services of an operator who initiates the splice sequence at his discretion. The machine described in U.S. Pat. No. 3,891,158 includes a device for detecting when the web tail leaves the roll so that maximum utilization of the web from the running roll may be achieved. The machine described in U.S. Pat. No. Re. 29,365 requires a means for sensing the diameter of the running roll. Each of these patents is mentioned only as being illustrative of splicing apparatus to which the present invention could be applied.

Specific controls for splicers are described in U.S. Pat. Nos. 3,713,600; 3,822,828 and 4,089,482. In U.S. Pat. No. 3,713,600 a braking force is applied directly to the web festoon to accelerate movable rolls in the festoon so that web payout velocity increases as a ratio of the pull velocity. U.S. Pat. No. 3,822,838 describes apparatus for controlling a splicer which is responsive to reduction of the diameter of the running roll to a predetermined dimension. U.S. Pat. No. 4,089,482 pertains to an automatic web splice control regulated by the length of web unwound from the running roll.

SUMMARY OF THE INVENTION

The present invention is directed to a splice control apparatus wherein the web from a running roll is spliced to the web from a reserve roll at a predetermined moment after the application of a splice command signal. The moment when the reserve roll is spliced to the running roll is determined by the rate at which the speed of the running roll is decreased after generation of the splice command signal.

The web from the running roll traverses a festoon in which an amount of the web is stored. By decreasing the speed of the running roll linearly at a rate R1 which is independent of the initial speed V of the running roll, the percentage of web drawn from the festoon can be limited to a fixed value. For example, the consumption of web from the festoon during braking can be limited to 50% of the maximum festoon capacity for maximum initial speed V max at the time of a splice. For lower initial speeds V of the running roll, the consumption of web from the festoon will be proportionately reduced. This provides a desirable cushioning effect during the splice and uniform tensioning of the web during braking of the running roll. Similarly, the reserve roll can be accelerated to initial speed V at a constant rate R2 to minimize web tension, utilizing the remaining festoon capacity.

When a splice command signal is applied, the speed of the web from the running roll is reduced from the speed V linearly at a rate R1. The amount of web stored in the festoon is decreased as the speed of the running roll is reduced. The rate at which the amount of web stored in the festoon decreases is monitored and, when the rate reaches a preselected fraction of the initial speed V of the running roll, which indicates approximate zero speed of the web from the running roll, the web is spliced to the web from the reserve roll. Thereafter, the web from the reserve roll is drawn out and increased linearly from zero to the speed V.

Accordingly, a principal object of this invention is to provide a web splicer control system in which the splicing of the webs can be effected at a predictable moment.

Another object of this invention is to provide a web splicer control system in which the payout of the web from the reserve roll occurs at a controllable rate.

A further object of this invention is to provide a splicer control system in which the tension on the running roll during braking and acceleration is uniform.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
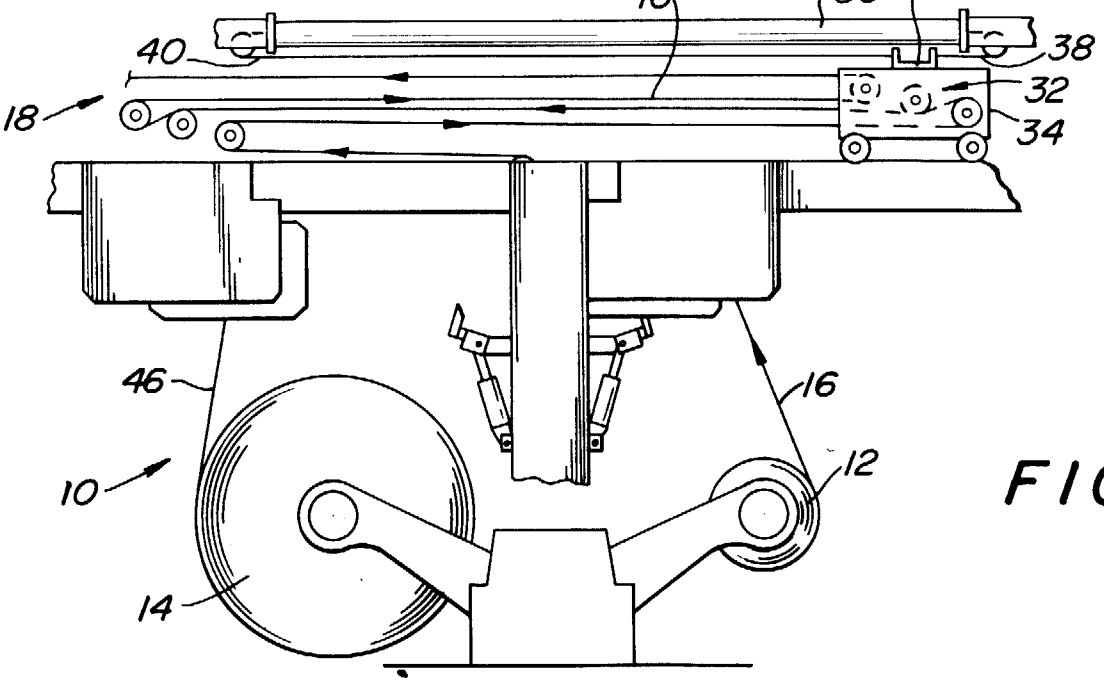
FIG. 1 is a diagram of an exemplary splicer machine controlled by the splicer control of the present invention.

Referring to the drawings in detail, wherein like numerals indicate like elements, there is shown in FIG. 1 a splicer machine 10 of conventional construction having a running roll 12 and a reserve roll 14. Such a machine is described in detail in U.S. Pat. No. 3,841,944 entitled "Web Splicing Apparatus". Web 16 is unwound from the running roll 12 and is stored in a festoon 18.

Figure 2:
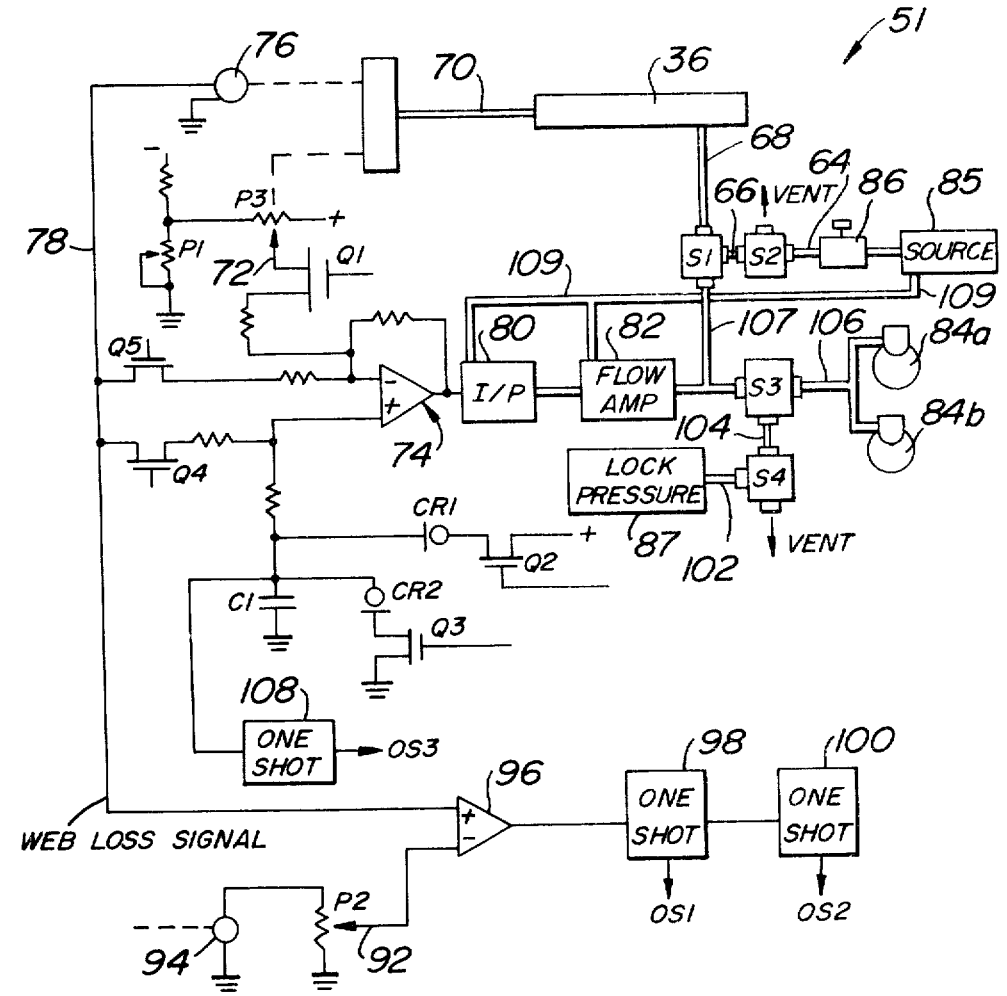
FIG. 2 is a block diagram of the splicer control of the present invention.
Figure 2:
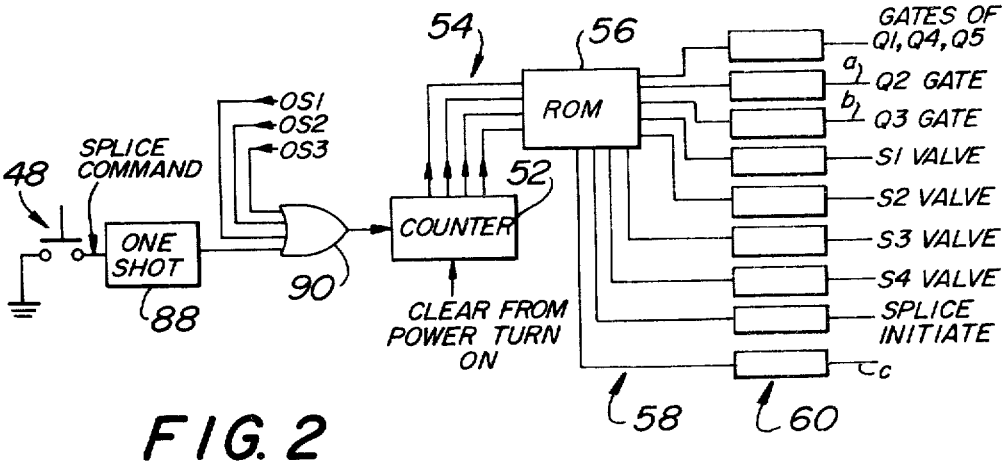

The web 16 stored in the festoon 18 is wound around a group of rollers 32 mounted in a wheeled carriage 34 in the festoon. The carriage is moved under control of a cylinder 36 having a piston 70 (shown in FIG. 2) to which cables 38 and 40 are connected. The cables 38 and 40 are coupled to a bracket 33 on the carriage 34.

As the web 16 is consumed from the running roll 12, the web 46 of the reserve roll 14 is spliced by the splicer machine 10 in response to a splice command signal. The splice command signal may be applied manually by an operator depressing a pushbutton switch 48 or the like. See FIG. 2.

The splicer machine 10 is controlled by the control 51 of the present invention. See FIG. 2.

ZERO COUNT OF COUNTER 52

Before a splice command signal is applied, control 51 maintains the festoon carriage 34 at almost fully extended position so that an amount of web U is stored in the festoon 18.

A counter 52 having multiple bit outputs 54 contains a zero count before the splice command signal is applied. The counter 52 may be cleared or reset to the zero count upon the application of power. The counter 52 addresses a ROM 56 which is programmed to provide a multiple bit digital work output for each of the memory addresses. The multiple bit outputs of the ROM 56 are designated collectively as 58 in FIG. 2. These outputs control the states of various components of the splicer control 51 via a bank of drivers 60. The driver outputs the states of FETs Q1–Q5 and a group of three-way solenoid valves S1–S4.

Before the splice command signal is applied, the outputs of drivers 60 control the gates of FETs Q1–Q5 to maintain FETs Q1, Q3 and Q5 on FETs Q2 and Q4 off. In addition, the driver outputs control solenoid valves S1–S4 to cause solenoid valves S1 and S2 to direct pressurized fluid (liquid or gas) from a fluid source 85 and a pressure regulator 86 through conduits 64, 66 and 68 to the festoon cylinder 36. The fluid exerts pressure on the piston 70 causing the festoon carriage 34 to move to almost fully extended position (shown in FIG. 1) wherein an amount U of web is stored in the festoon.

A festoon potentiometer P3 is mechanically coupled to the piston 70 to provide a festoon position signal 72 indicative of the piston position, hence the position of carriage 34, to FET Q1. The festoon position signal 72 is transmitted by the FET Q1 to the inverting input of difference amplifier 74. The amplifier 74 compares the festoon position signal 72 to a zero volt signal provided by FET Q3 and constant current diode CR2 at the non-inverting input of the operational amplifier.

Movement of the piston 70, hence carriage 34, is sensed by a tachometer 76 mechanically coupled to piston 70. The tachometer 76 provides a speed signal 78 indicative of the speed of the carriage 34, hence the rate at which web stored in festoon 18 is consumed. Speed signal 78 is transmitted by FET Q5 to the inverting input of operational amplifier 74 where it is summed with the piston position signal 72 transmitted by FET Q1 and compared to the zero volt signal from FET Q3 and diode CR2.

The amplifier 74 drives a current-to-pressure transducer 80 (such as a Moore Products model GC-77 transducer) which supplies fluid pressure to a flow amplifier 82. The flow amplifier 82 controls a pair of brakes **84*a* and 84*b* (associated with the running roll 12 and reserve roll 14 respectively) via the solenoid valve S3. The solenoid valve S3 is controlled by one of the drivers 60 to direct pressurized fluid to brakes 84*a* and 84*b***.

Fluid supplied through conduits 64, 66 and 68 to cylinder 36 is maintained at a constant pressure by the pressure regulator 86. As previously indicated, the fluid tends to move the piston 70 so that the festoon carriage 34 moves to almost fully extended position (shown in FIG. 1) at which an amount U of web is stored in the festoon. If the speed of the running roll 12 exceeds the line speed V, the festoon carriage tends to move beyond this position to the fully extended position (to the right in FIG. 1). By line speed V is meant the speed at which web 16 travels past the festoon exit point. This produces a negative piston position signal 72 at the output of festoon potentiometer P3. As a result, the output of amplifier 74 causes the current-to-pressure transducer 80 and flow amplifier 82 to increase the fluid pressure to brakes **84*a* and 84*b*. Brake 84*a* reduces the speed of the running roll back towards the line speed V, and tension of the web 16** causes the festoon carriage to return to almost fully extended position.

Thus, the control circuit 51 maintains the festoon carriage 34 at almost fully extended position in response to the festoon position signal 72 and the tachometer output 78. The purpose of the tachometer output 78 is to limit the speed of correction of the position of the festoon carriage and to stabilize the servo system.

In sum, the fluid pressure in conduits 64, 66 and 68 and the fluid pressure to brake **84*a* counterbalance each other so that the carriage 34 remains at almost fully extended position with an amount U of web 16 stored in the festoon. If the web from running roll 12 moves at the line speed V, the carriage remains stationary and the amount of web 16 entering the festoon 18 will equal the amount of web 16** leaving the festoon.

The control 51 maintains the splicer machine 10 in this condition until the state of the counter 52 is changed. The state of the counter 52 is changed when a splice command signal is applied either manually by operation of switch 48 or automatically.

COUNT 1 OF COUNTER 52

When a splice command signal is applied, control 51 regulates the rate of movement of the festoon carriage 34, hence the rate at which web is withdrawn from the festoon.

The splice command signal triggers a one shot 88. The one shot 88 clocks the counter 52 via an OR gate 90. The counter advances one count (to count 1) and steps to the next ROM address. The ROM outputs 58 change state accordingly. The outputs of drivers 60 change state in response, turning off FETs Q1, Q3 and Q4. FET Q2 switches from the off to the on state. FET Q5 continues to transmit the tachometer output 78 to the inverting input of amplifier 74.

The solenoid valve S2 is switched by its associated driver to vent fluid. Fluid passes from cylinder 36 through conduit 68, solenoid valve S1 and conduit 66 to solenoid valve S2. Accordingly, the carriage 34 is now free to move from the almost fully extended position.

Since FET Q1 is now off, the festoon position signal 72 is not transmitted to the amplifier 74. Since FET Q2 is now on, current passes through FET Q2 and constant current diode CR1 to charge the capacitor C1 linearly. The voltage across capacitor C1, therefore, ramps up. The capacitor ramp voltage is transmitted to the non-inverting input of amplifier 74 and is compared to the tachometer output 78 passing through FET Q5. The control 51, therefore, behaves like a speed servo with the rate of movement of the festoon carriage and the voltage ramp across capacitor C1 determining the fluid pressure to brake **84*a***.

In particular, the amplifier 74, current-to-pressure transducer 80 and flow amplifier 82 cause the fluid pressure to brakes **84*a* and 84*b* to increase via solenoid valve S3 and conduit 106. This causes the speed of the running roll 12** to decrease from initial line speed V linearly at a rate R1 determined primarily by the slope of the ramp voltage across capacitor C1.

As the speed of the running roll 12 decreases linearly, tension of the web 16, owing to the difference in web speeds at the festoon entrance and exit points, causes the piston 70 to collapse from the almost fully extended position. As a result, web 16 is withdrawn from the festoon at an increasing rate determined by the slope of the capacitor ramp voltage.

The speed of the festoon carriage is indicated by the tachometer output 78. The tachometer output 78 is compared to a threshold speed signal 92 produced by a web line speed tachometer 94 and potentiometer P2. The tachometer 94 is mechanically coupled to a web drive roller (not shown) which draws the web at line speed from the festoon. The tachometer indicates the line speed, that is, the speed at which the web 16 leaves the festoon. This is also the initial speed V of the running roll. The threshold signal 92 represents a preselected fraction of the line speed.

The preselected fraction is chosen to permit detection of zero or substantially zero speed of the running roll 12. It can be shown that the preselected fraction should be the inverse of the number of paths of travel of the web 16 in the festoon. When the speed of the festoon carriage is equal to the preselected fraction of line speed, the running roll speed will be zero or substantially zero.

The tachometer output 78 is compared to the threshold speed signal 92 by a comparator 96. When the tachometer output 78 reaches the threshold speed signal 92, the comparator 96 generates a web speed signal which triggers a one shot 98. Potentiometer P2 is adjusted so that equality of the signals 78 and 92 indicates that the speed at which the web is drawn from running roll 12 has reached zero or substantially zero speed. The running roll web can now be spliced safely without tearing the web.

When the speed of the festoon carriage equals the preselected fraction of line speed, the comparator 96 triggers a one shot 98 which generates a OS1 signal. The OS1 signal passes through OR gate 90 to advance the counter 52 one count (to count 2). The counter outputs 54, therefore, step to the next address of ROM 56, and the ROM outputs 58 change state accordingly. In addition, when one shot 98 is triggered, it triggers a one shot 100 which, after a predetermined delay interval, generates a signal OS2.

COUNT 2 OF COUNTER 52

Before signal OS2 is generated, the OS1 signal advances the counter to count 2 as previously described. The ROM outputs 58 change state. As a result, the drivers 60 turn all FETs Q1–Q5 off, switch the solenoid valves S3 and S4 to lock brakes 84*a* and 84*b*, and generate a splice initiate signal.

A fluid source 87 provides fluid under sufficient pressure via conduit 102, solenoid valve S4, conduit 104, solenoid valve S3 and conduit 106 to lock brakes 84*a* and 84*b*.

During this time, the fluid in cylinder 36 continues to vent through conduit 68, solenoid valve S1, conduit 66 and solenoid valve S2, and the festoon continues to collapse to remove tension from web 16. In addition, the splice initiate signal is transmitted by one of the drivers 60 to the splicer machine 10. The splicer machine, in response, initiates a splice sequence in which the web 16 from running roll 12 is spliced to the web 46 from reserve roll 14.

The one shot 100 generates the OS2 signal to advance the count of counter 52 a predetermined delay interval after the OS1 signal is generated. The delay interval is chosen to be sufficiently long to ensure completion of each of the above steps including the splice operation. The OS2 signal passes through OR gate 90 to advance the counter one step (to count 3).

COUNT 3 OF COUNTER 52

In response to the OS2 signal, the counter outputs 54 step to the next address of ROM 56, and the ROM generates a new set of outputs 58. The drivers 60 switch the FETs Q3 and Q4 on while maintaining FETs Q1, Q2 and Q5 off. In addition, the driver associated with solenoid valve S1 switches the solenoid valve to permit fluid to flow under pressure from flow amplifier 82 through conduit 107, solenoid valve S1 and conduit 68 to cylinder 36. The driver associated with solenoid valve S4 switches the solenoid valve to permit brake fluid to vent through conduit 106, solenoid valve S3, conduit 104 and solenoid valve S4. As a result, brake 84*b* releases the new running roll (old reserve roll 14) so that the web speed increases linearly at a rate R2 up to the speed V.

Since FET Q4 is on during this time, the tachometer output signal 78 is passed to the non-inverting input of amplifier 74 rather than to the inverting input of the amplifier. Since FET Q3 is on, the capacitor C1 discharges linearly through FET Q3 and constant current diode CR2. As a result, the voltage across the capacitor ramps down.

The output of the amplifier 74 is now determined by the decreasing ramp voltage across capacitor C1 summed with the tachometer output signal 78. The fluid pressure to the cylinder 36 is controlled by the current-to-pressure transducer 80 and flow amplifier 82 in response to the output of the difference amplifier 74.

Accordingly, change of pressure to the cylinder 36 forces the festoon carriage speed to ramp down and the tachometer output 78 to ramp to zero. At this point, the festoon reaches maximum collapse (minimum web storage).

The rates of web acceleration and deceleration are such that the festoon is not fully collapsed when the web from the reserve roll has reached line speed V.

The voltage across the capacitor C1 reaching zero volts triggers a one shot 108 which generates a OS3 signal. The OS3 signal passes through the OR gate 90 to return the counter 52 to the reset or zero state. Accordingly, counter 52 counts from zero through 3 and back to zero whenever a splice command signal is applied. When the counter 52 returns to the zero state, the festoon carriage is returned to the almost fully extended position so that the amount U of web 16 is stored in the festoon as previously described.

CONSTANT RATE R1 OF SPEED REDUCTION

By reducing the speed of the running roll 12 linearly at a rate R1, the point in time at which the splice of running web 16 and reserve web 46 is effected (following the splice command signal) becomes predictable.

Figure 3:
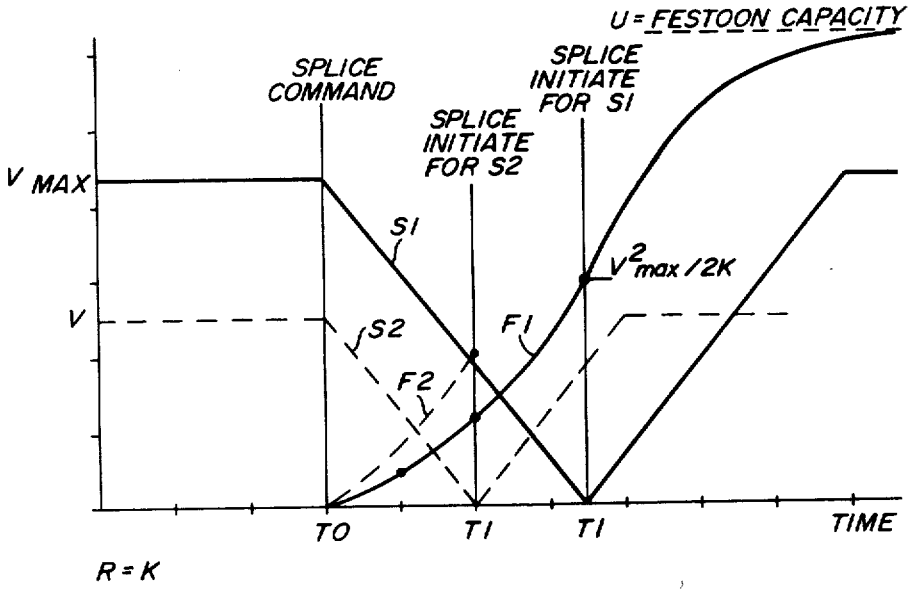
FIG. 3 is a chart of the speed of the running roll and the amount of web stored in the festoon for the case $R=K$.

Referring to FIG. 3, the splice command signal is applied at some time T0. The speed S of the running roll 12 is reduced linearly at the rate R1 from initial or line speed V at T0 to zero or near zero speed at time T1. At time T1, the splice initiate signal is generated, and webs 16 and 46 are spliced by the splicer machine 10.

For purposes of simplicity, let the time T0=0. The equation for the speed of the running roll 12 is:

$$S=V-R1\times t \quad (1)$$

where t=time.

The amount of web 16 withdrawn from the festoon 18 is given by the integral of the difference between the speed at which the web is moving at the exit of the festoon (initial or line speed V) and the speed at which the web is traveling at the entrance of the festoon (speed S). The amount of web withdrawn from the festoon is given by the equation:

$$F=R1\times t^2/2 \quad (2)$$

The amount of web withdrawn from the festoon is therefore a parabolic function of time.

The rate of decrease of the speed of the running roll 12 is:

$$R=V/(T1-T0)=V/T1 \quad (3)$$

The amount of web withdrawn from the festoon at the time T1 of the splice initiate signal is therefore:

$$F=VT1/2 \quad (4)$$

Expressing the amount of web F lost from the festoon in terms of the amount of web U stored in the festoon before reduction of the speed of the running roll, the percentage of web withdrawn from the festoon at time T1 is:

$$F/U=VT1/2U \quad (5)$$

The rate R1 at which the speed of the running roll 12 is decreased is determined by the rate of rise of the ramp voltage across the capacitor C1. See FIG. 2. If the gates of FETS Q2 and Q3 are directly controlled by the driver outputs a and b as already described, the rate of rise of the ram voltage is substantially constant regardless of the value of the initial speed V of the running roll. That is, the rate R1 is:

$$R1=K \quad (6)$$

where K is some constant.

The time T1 at which webs 16 and 46 are spliced is:

$$T1=V/R1 \quad (7)$$

Accordingly, the time T1 for the case of R1=K is:

$$T1=V/K \quad (8)$$

and the percentage of web withdrawn from the festoon at time T1 is:

$$F/U=V^2/2KU \quad (9)$$

For any initial speed V of the running roll, therefore, the time T1 of the splice following generation of the splice command signal and the percentage F/U of material from the festoon at time T1 are known. The percentage F/U of material withdrawn from the festoon will vary with the square of the initial speed V of the running roll.

The rate at which the voltage across capacitor C1 rises can be fixed to ensure that, at the highest permissible initial speed Vmax of the running roll, the percentage of web withdrawn from the festoon at the time T1 of the splice is approximately 50 percent. Setting F/U in equation (9) to ½ and re-arranging terms, the rate of rise of the voltage across the capacitor C1 is chosen to produce a rate of decrease of the running roll speed which is:

$$R1=K=V^2\max/U \quad (10)$$

For any other initial speed V of the running roll less than the speed Vmax, the percentage F/U of web lost from the festoon at time T1 will be lower than 50%. In other words, for any such initial speeds of the running roll, the festoon carriage 34 will collapse less than halfway from time T0 to time T1. This provides a desirable cushioning effect on the web during splice.

By maintaining the rate R1 of decrease of the speed of the running roll at the constant K independent of the initial speed V of the running roll, the percentage F/U of web withdrawn from the festoon at time T1 therefore becomes pedictable in a range with an upper limit of 50%. The remaining 50% or more of web in the festoon may then be drawn out as the reserve roll is brought up to speed.

Moreover, for any value of the initial running roll speed V, reduction of speed of the running roll at the constant rate K produces the same web tensions between times T0 and T1. Thus, for lower initial speeds V of the running roll, web tension during reduction of speed of the running roll will be the same as web tension during reduction of speed of the running roll from the maximum initial speed Vmax.

VARIABLE RATE R1

The percentage F/U of web withdrawn from the festoon at the time of splice T1 can be fixed, for example at 50%, for any initial speed V and the tension on the web 16 during reduction of speed of the running roll can be made lower for lower initial speeds V of the running roll. At the same time, the predictability of the splicer is maintained. This can be accomplished by varying the rate of rise of the voltage across the capacitor C1 depending on the initial speed V to maintain the product VT1 equal to a constant. Denoting the constant as H, and choosing H to be equal to the amount U of web initially stored in the festoon, the percentage of web withdrawn from the festoon by the time T1 as given in equation (5) will be fixed at:

$$F/U=H/2U=U/2U=\tfrac{1}{2} \quad (11)$$

Thus, despite the initial speed V of the running roll, decrease of speed of the running roll at a rate R1 such that the product VT1 is constant and equal to U will result in exactly 50% loss of web from the festoon at time T1. Of course, other percentages of festoon depletion at time T1 may be used in practicing the invention by appropriate choice of the constant H. The optimum percentage depends on a statistical analysis of the ratios of running and reserve roll sizes.

For the product VT1 to be constant, the rate R1 of decrease of speed of the running roll must be made a parabolic function of the initial speed V of the running roll:

$$R1=V/T1=V/(H/V)=V^2/H \quad (12)$$

Figure 4:
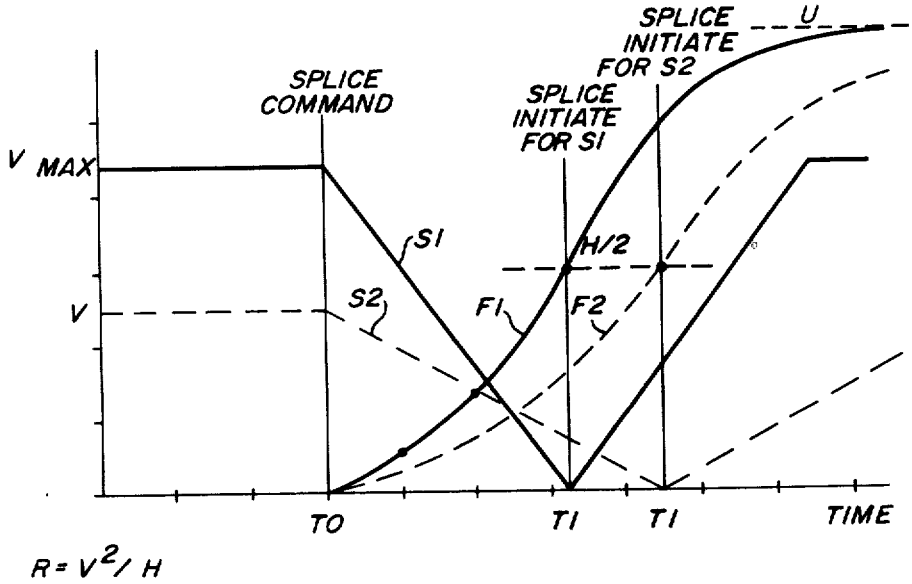
FIG. 4 is a chart of the speed of the running roll and the amount of web stored in the festoon for the case $R=V^2/H$.

The above relationship between the rate R1 and initial speed V is shown in FIG. 4.

Since web tension varies with the rate R1 of decrease of speed of the running roll, the web tension will decrease substantially for lower initial speeds V of the running roll.

The rate of acceleration of the web from the reserve roll should also be a function of $V^2$ to minimize web tension in the acceleration phase. This provides for total collapse of the festoon at all speeds.

Figure 5:
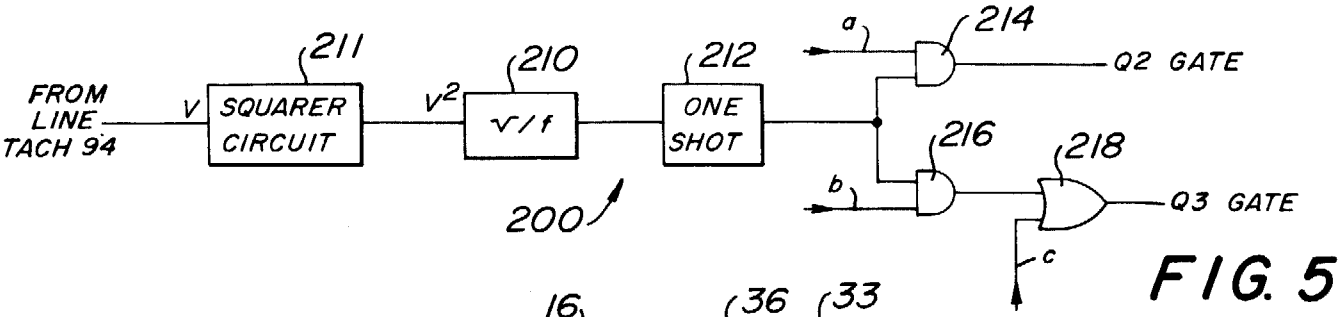
FIG. 5 is a block diagram of a circuit which varies the rate of speed reduction of the running roll based on initial roll speed.

To vary the rate R1 according to equation (12) to obtain a constant product VT1, a circuit 200, see FIG. 5, is interposed between the driver outputs a, b and c and the gates of FETs Q2 and Q3 in control circuit 51. The driver output c is not necessary for operation of circuit 51 for the case of constant rate R1=K, in which case the gates of FETs Q2 and Q3 are directly controlled by driver outputs a and b as previously described.

Referring to FIG. 5, circuit 200 includes a voltage-to-frequency converter 210 which generates a stream of pulses whose frequency varies with the output of a squarer circuit 211. The output of circuit 211 is proportional to the square of the initial or line speed V as indicated by line speed tachometer 94. Thus, the output of the voltage-to-frequency converter 210 provides an indication of the squared initial or line speed V of the running web.

The pulse output of converter 210 triggers a one shot 212. The output of one shot 212 is therefore a pulse train whose frequency varies with the square of the initial speed V, each pulse in the train having a fixed pulse-width determined by the one shot. The pulse output of the one shot 212 is transmitted through a pair of AND gates 214, 216 depending on the driver outputs a, b and c.

As previously indicated, for the case of R1=K, the driver output a maintains FET Q2 off during the 0, 2 and 3 counts of counter 52. During the 1 count of counter 52, the output a turns FET Q2 on to enable capacitor C1 to charge. As capacitor C1 charges, the speed of the running roll is reduced at rate R1 which is determined by the rate at which the capacitor C1 charges.

For the case of a variable rate R1, during the 1 count of counter 52, the driver output a enables the AND gate 214 to pass the output of one shot 212 to the gate of FET Q2. Accordingly, the capacitor C1 charges in stepped intervals, and the rate of charge of the capacitor C1 very closely approximates a straight line curve whose slope is proportional to the frequency from the voltage to frequency converter. As a result, the running roll speed is reduced substantially linearly at the rate R1 which has a value proportional to the square of the initial running roll speed V such that the product VT1 is constant for any initial speed V.

As previously indicated, for the case of R1=K, the driver output b maintains FET Q3 on during the 0 and 3 counts of counter 52. In addition, the driver output b maintains the FET Q3 off during the 1 and 2 counts of counter 52. During the 0 count of counter 52, the FET Q3 keeps the voltage at capacitor C1 clamped to ground, and control 51 maintains the festoon carriage 34 at almost fully extended position. During the 1 count of counter 52, the FET Q3 is maintained off to permit the capacitor C1 to charge as the running roll is braked and the festoon carriage begins to collapse. During the 2 count of counter 52, the FET Q3 remains off and capacitor C1 holds its charge to permit the festoon carriage to continue to collapse while the splice signal initiate signal is generated and a splice is effected. During count 3 of counter 52, the FET Q3 is turned on to permit capacitor C1 to discharge so that the new running roll can be brought up to speed at the rate R while the rate of collapse of the festoon is retarded.

For the case of a variable rate R1, circuit 200 passes the output of one shot 212 to the gate of FET Q3 only during the 3 count of counter 52. This is accomplished by AND gate 216 and an OR gate 218. Thus, driver output b enables AND gate 216 during the 3 count of counter 52, while driver output c provides a "zero" binary signal to OR gate 218. The OR gate 218 passes the output of one shot 212 to the gate of FET Q3 to permit the capacitor C1 to discharge in stepped intervals. The rate of discharge of capacitor C1 very closely approximates a straight line curve whose slope is proportional to the square of the initial speed V (of the old running roll).

The use of deceleration and acceleration ramps which are proportional to the square of the initial speed V permits maximum utilization of the festoon for minimizing web tension during splicing.

During count 0 of counter 52, the driver output c provides a "one" binary signal to OR gate 218, and the OR gate keeps FET Q3 on. Capacitor C1 therefore remains clamped to ground. During counts 1 and 2 of counter 52, driver output b keeps AND gate 216 disabled and driver output c provides a "zero" binary signal to OR gate 218. Accordingly, the OR gate keeps FET Q3 off.

Operation of FETs Q2 and Q3 and capacitor C1 in response to the driver outputs a, b and c for the case of variable R1 is summarized in Table 1 below.

TABLE 1

| Count of | Driver Outputs | | | | | |
|---|---|---|---|---|---|---|
| Counter 52 | a | b | c | FET Q2 | FET Q3 | Capacitor C1 |
| 0 | 0 | 1 | 1 | off | on | clamped |
| 1 | 1 | 0 | 0 | on | off | charge |
| 2 | 0 | 0 | 0 | off | off | hold |
| 3 | 0 | 1 | 0 | off | on | discharge |

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for controlling a splicer machine which splices a web from a running roll to a web from a reserve roll, said splicer machine including a festoon for storing an amount of web from the running roll, comprising:

means for reducing the speed at which web is drawn from the running roll at a rate R1 from an initial speed V in response to a splice command signal, said rate R1 being proportional to the square of said initial speed V, means for generating a web speed signal indicative of whether the speed at which web is drawn from said running roll has reached substantially zero speed, means for generating a splice initiate signal in response to said web speed signal, actuating thereby the splicer machine to splice the web from the running roll to the web from the reserve roll, and means for increasing the speed at which web is drawn from the reserve roll at a rate R2 up to the initial speed V.

2. Apparatus according to claim 1 including means for maintaining said rate R2 constant regardless of said speed V.

3. Apparatus according to claim 2 wherein said means for maintaining said rate R2 constant includes a capacitor and a constant current diode connected to said capacitor.

4. Apparatus according to claim 1 wherein said means for generating said web speed signal includes means for generating a web loss signal indicative of the rate at which the amount of web stored in said festoon is drawn from said festoon as the speed of the web drawn from said running roll is reduced, means for generating a threshold speed signal representative of a preselected fraction of the speed at which the web is drawn from said festoon, and means for comparing said web loss and threshold speed signals.

5. Apparatus for controlling a splicer machine which splices a web from a running roll to a web from a reserve roll in response to a splice initiate signal, said splicer machine including a festoon for storing an amount of the web from the running roll as web is drawn from the running roll by a web consuming machine, comprising:

means for initially maintaining the amount of web stored in the festoon constant, means for reducing linearly the speed of the running roll from a speed V at a rate R1, means for controlling the rate at which the web stored in said festoon is drawn from said festoon as the speed of said running roll decreases, means for generating a splice initiate signal when the rate at which the web drawn from said festoon is a preselected fraction of the speed V, and means for increasing linearly the speed of the web from the reserve roll at a rate R2 up to the speed V.

6. Apparatus according to claim 5 including means for varying said rates R1 and R2 in proportion to the square of said speed V.

7. Apparatus according to claim 5 including means for maintaining said rates R1 and R2 substantially constant regardless of said speed V.

8. Apparatus according to claim 7 wherein said means for maintaining said rates R1 and R2 constant includes a capacitor and a constant current diode connected to said capacitor.

9. A method of controlling a splicer machine which splices a web from a running roll to a web from a reserve roll in response to a splice initiate signal, said splicer machine including storing means for storing an amount of web from the running roll as web is drawn from the running roll by a web consuming machine, comprising:

initially maintaining the amount of web stored in said storing means at a constant value, reducing the speed of the web from the running roll from a speed V at a rate R1 which varies in proportion to the square of said speed V, controlling the rate at which the web is drawn from said storing means as the speed of said running roll decreases, generating a splice initiate signal when the running roll has reached substantially zero speed, actuating thereby the splicer machine to splice the webs from the running and reserve rolls, and increasing the speed of the web from the reserve roll at a rate R2 up to the speed V.

10. The method according to claim 9 including varying each of said rates R1 and R2 in proportion to the square of speed V.

11. The method according to claim 9 including maintaining each of said rates R1 and R2 constant.

12. The method according to claim 10 including limiting the amount of web drawn from said storing means at the time that the splice initiate signal is generated to a constant amount.

13. The method according to claim 12 including limiting the amount of web drawn from said storing means to one-half the amount of web stored prior to reducing the speed of the web from said running roll.

14. Apparatus for controlling a splicer machine which splices a web from a running roll to a web from a reserve roll, said splicer machine including a festoon for storing an amount of web from the running roll, comprising:

means for reducing the speed at which web is drawn from the running roll linearly at a rate R1 from an initial speed V in response to a splice command signal, said rate R1 being constant and independent of said initial speed V.

means for generating a web speed signal indicative of whether the speed at which web is drawn from said running roll has reached substantially zero speed, means for generating a splice initiate signal in response to said web speed signal, actuating thereby the splicer machine to splice the web from the running roll to the web from the reserve roll, and means for increasing the speed at which web is drawn from the reserve roll at a rate R2 up to the initial speed V.

15. Apparatus according to claim 14 wherein said means for generating said constant linear rate R1 includes a capacitor and constant current diode connected to said capacitor.

16. Apparatus according to claim 14 wherein said means for generating said web speed signal includes means for generating a web loss signal indicative of the rate at which the amount of web stored in said festoon is drawn from said festoon as the speed of the web drawn from said running roll is reduced, means for generating a threshold speed signal representative of a preselected fraction of the speed at which the web is drawn from said festoon, and means for comparing said web loss and threshold speed signals.

17. A method of controlling a splicer machine which splices a web from a running roll to a web from a reserve roll in response to a splice initiate signal, said splicer machine including storing means for storing an amount of web from the running roll as web is drawn from the running roll by a web consuming machine, comprising:

initially maintaining the amount of web stored in said storing means at a constant value, reducing the speed of the web from the running roll linearly from a speed V at a rate R1, said rate R1 being constant and independent of said speed V, controlling the rate at which the web is drawn from said storing means as the speed of said running roll decreases, generating a splice initiate signal when the running roll has reached substantially zero speed, actuating thereby the splicer machine to splice the webs from the running and reserve rolls, and increasing the speed of the web from the reserve roll at a rate R2 up to the speed V.

18. A method of controlling a splicer machine which splices a web from a running roll to a web from a reserve roll in response to a splice initiate signal, said splicer machine including storing means for storing an amount of web from the running roll as web is drawn from the running roll by a web consuming machine, comprising:

reducing linearly the speed of the web from the running roll from a speed V at a rate R1, generating a web loss signal indicative of the amount of web drawn from said storing means as the speed of said running roll decreases, generating a splice initiate signal when said web loss signal is a preselected fraction of the speed of the web being drawn from said storing means, actuating thereby the splicer machine to splice the webs from the running and reserve rolls, and increasing linearly the speed of the web from the reserve roll at a linear rate R2 up to the speed V.

19. The method according to claim 18 including varying each of said linear rates R1 and R2 in proportion to the speed V.

20. The method according to claim 18 including maintaining each of said linear rates R1 and R2 constant.

21. The method according to claim 19 including limiting the amount of web drawn from said storing means during a splice to a constant amount.

22. The method according to claim 21 including limiting said amount of web drawn from said storing means to an amount less than one-half the amount of web stored in said storing means prior to reducing the speed of the web from said running roll.

* * * * *